United States Patent [19]

Fischer

[11] Patent Number: 4,632,308

[45] Date of Patent: Dec. 30, 1986

[54] ADJUSTABLE RAIL FASTENER ASSEMBLY

[75] Inventor: Richard L. Fischer, Bolingbrook, Ill.

[73] Assignee: Portec, Inc., Oak Brook, Ill.

[21] Appl. No.: 791,519

[22] Filed: Oct. 25, 1985

[51] Int. Cl.[4] ..... E01B 9/48; E01B 9/66; E01B 9/68

[52] U.S. Cl. ..... 238/265; 238/282; 238/283; 238/310; 238/331; 238/351

[58] Field of Search ..... 238/264, 265, 282, 283, 238/310, 331, 338, 341, 349, 351

[56] References Cited

U.S. PATENT DOCUMENTS

| | | | |
|---|---|---|---|
| 1,781,251 | 11/1930 | Schwendt et al. | 238/282 X |
| 3,662,951 | 5/1972 | Smith et al. | 238/310 X |
| 3,724,754 | 4/1973 | Molyneux et al. | 238/349 |
| 3,826,423 | 7/1974 | McClung | 238/264 |
| 4,208,011 | 6/1980 | Dahlhaus et al. | 238/310 X |
| 4,267,970 | 5/1981 | Lubbers | 238/310 |
| 4,424,935 | 1/1984 | Langman et al. | 238/349 |
| 4,527,736 | 7/1985 | Ortwein | 238/283 |

FOREIGN PATENT DOCUMENTS

| | | | |
|---|---|---|---|
| 510210 | 10/1930 | Fed. Rep. of Germany | 238/264 |
| 2345647 | 3/1974 | Fed. Rep. of Germany | 238/351 |
| 335711 | 3/1959 | Switzerland | 238/351 |

*Primary Examiner*—Randolph Reese
*Assistant Examiner*—David F. Hubbuch
*Attorney, Agent, or Firm*—Anthony A. O'Brien

[57] ABSTRACT

A rail fastener assembly includes a rail seat laterally shiftable incrementally to properly position a supported rail. Anchoring of the seat to an underlying foundation is achieved by a clamp ring surrounding the periphery of the seat and including a plurality of fastener-receiving openings having their centers variably spaced from the seat. Rotation of the clamp ring presents at least two fastener-receiving openings in overlying registry with hold-down elements in the foundation to enable the application of fasteners through the clamp ring to secure the seat to the foundation. A pair of symmetrical spring clips engage shoulders on the seat and include a medial hold-down portion biased against the rail flanges and fixed, distal shoulder engaging portions overlying each rail flange but normally spaced thereabove to limit deflection of the clips during vertical movement of the rail.

25 Claims, 9 Drawing Figures

ADJUSTABLE RAIL FASTENER ASSEMBLY

This invention relates generally to rail fasteners and more particularly to an improved assembly readily permitting lateral incremental adjustment of the supported rail.

It is well known to provide a rail fastener assembly adapted to be manipulated for the purpose of providing selective lateral positioning of the rail being secured by the fastener assembly. An example of such an assembly will be found in U.S. Pat. No. 3,724,754 issued Apr. 3, 1973 to Molyneux et al and which is representative of several devices wherein a pair of adjustable components are laterally disposed of the two base flanges of a rail and include an eccentric configuration whereby upon coordinated rotation of the two eccentric components, the rail base contained therebetween is laterally displaced.

The present invention is particularly advantageous for use on metropolitan mass transit systems. Until recently, the engineering of transit systems for the most part followed usual railroad practice by employing ballasted track, wood ties and conventional track fastenings with final track spacing adjustments being accomplished by conventional lining and surfacing techniques.

With the advent of the current improved pre-stressed concrete, track construction, particularly for transit systems, has departed from wood ties and ballast to foundations comprising concrete ties, slabs and aerial bridge structures. However, with these new construction systems there has surfaced a whole myriad of problems, primarily associated with the rail/foundation interface or how to hold the rail to the concrete. Also, the concrete has been found to fail to attenuate the noise generated, which has added to the problem.

By the present arrangement, a vastly improved installation is achieved which offers a superior rail/foundation interface, precise lateral rail spacing and at the same time noticeably improves the attenuation of the impact and audible sound. This improved assembly comprises a single rotatably displaceable clamp ring associated with each fastener assembly and includes an enlarged opening receiving a rail seat member. The diameter of the single clamp ring is substantially greater than the width of the cooperating rail base and a plurality of slots or openings adjacent the ring periphery are adapted to receive removable fastener members serving to attach the assembly to the associated foundation or substructure. This fixation of the clamp ring may be by means of bolts retained by anchor members within an underlying cross-tie or slab or may comprise fastener elements passing through the clamp ring openings and engaging an insert projecting upwardly from the underlying structure.

The above referenced attenuation is achieved by the inclusion of separate or integral dielectric insulator-/isolator elements adapted to be clamped or sandwiched between the rail seat member and foundation and between the rail seat member and clamp ring, respectively. In this manner, total isolation is achieved between the rail seat and sub-support structure. Along with the resultant vibration isolation there is provided a good load transfer through the material of the isolator-/insulator elements. Embodiments are proposed wherein boundary control of these insulator/isolator elements is achieved without the necessity of bonding, as is required in other available fastener assemblies for transit systems.

Following proper positioning of a rail and the seat member, the single clamp ring of the instant assembly is arcuately displaced to align selected ones of variously positioned fastener receiving openings therein with respect to appropriate hold-down means in the underlying foundation. Subsequent application of fastener elements through the selected ring openings serves to fixedly clamp the seat member in place thereby providing a totally isolated rail seat retained in place without any bolts therethrough or the necessity of bushings to electrically isolate it. During the above rotary movement of the clamp ring, various fastener receiving openings are passed over preinstalled hold-down means in the foundation. These openings or slots will be understood to be variably spaced from the seat receiving opening of the clamp ring. In other words, a circle or center line passing through these openings or base of these slots is eccentric to the seat receiving opening, thereby allowing use of the same fastener assembly components for variable lateral positioning of the rail while anchoring the assembly with the same fixed hold-down means in the foundation. During installation, positive control over the rail positioning is assured by two opposite rail flange engaging shoulders on the seat member and ultimate retention of the rail is provided by means of a pair of particularly configured spring clips retained by these seat shoulders and having portions respectively bearing upon the flanges of the rail base and engaging the seat shoulders.

The spring clips of the present invention provide a major enhancement of the fastener assembly by providing vastly improved retention means. The design of many prior rail fastener clips has involved a compromise in the selection of the spring rate, yield and/or toe load in order to meet the specifications of a particular fastener assembly installation. By the present arrangement, a unique assembly is offered including symmetrical spring clips having a suitable spring rate with portions of the clips constructed and installed in a manner to provide positive control over the amount of stress received by the clip by controlling vertical movement of the installed rail.

The instant construction allows for ready configuration to tailor the fastener assembly to accommodate a wide range of parameters. Thus by changing the mass of the rail seat itself and changing the insulator/isolator elements, the resultant performance can be regulated to attenuate sound or other harmful vibration, as well as control the spring rate of the fastener.

Accordingly, one of the objects of the present invention is to provide an improved adjustable rail fastener assembly including a clamp ring containing a nested seat member positioned beneath a rail base and which when laterally shifted to properly align a supported rail, is secured to a stationary foundation member by rotating the clamp ring to select individual ones of fastener receiving openings variably incrementally spaced from the seat member.

A further object of the present invention is to provide an improved adjustable rail fastener assembly including a seat member having an arcuate outer wall disposed within an opening in a clamp ring with this opening eccentric with respect to a circle containing a plurality of fastener-receiving openings adjacent the outer periphery of the clamp ring to allow transverse shifting of the seat member with subsequent anchoring of the assembly being obtained by arcuate displacement of the clamp ring to expose selected ones of the fastener receiving openings in registry with hold-down elements in an underlying foundation member.

Another object of the present invention is to provide an improved adjustable rail fastener assembly including a clamp ring underlying a rail base and provided with an opening housing a seat component with a circular insulating member disposed between the ring and seat whereupon clamping of the ring to a foundation member achieves a totally isolated fixed rail seat devoid of anchor bolts therethrough with alternative means available to provide boundary control of the insulating member without the need of bonding.

An additional object of the present invention is to provide an improved adjustable rail fastener assembly including a clamp ring containing a central seat member underlying a rail base wherein the ring is provided with a seat opening eccentric to the center line passing through a plurality of fastener openings adjacent the ring periphery and with a depending flange on the seat member configured with respect to the ring seat opening to insure an anchoring of the seat member as the clamp ring is tightened with respect to an underlying foundation.

A further object of the present invention is to provide an improved adjustable rail fastener assembly including an angularly adjustable clamp ring containing a seat member and disposed intermediate a rail base and foundation with a pair of symmetrical spring clips each having respective portions engaging the seat member and the flange of a rail base mounted upon the seat member.

Still another object of the present invention is to provide an improved adjustable rail fastener assembly including a rail supporting seat member nested within a clamp ring with improved spring clips carried by the seat member having alternate portions respectively in biased contact with the rail flanges and offering fixed abutments overlying the rail flanges to limit deflection of the clips upon vertical movement of the rail.

Another object of the present invention is to provide an improved adjustable rail fastener assembly including a laterally adjustable rail supporting seat member contained within an encircling angularly displaceable clamp ring with spring clips retaining the rail thereupon and comprising one-piece clips of elongated stock each including a medial portion biased against the rail flanges and a pair of outboard distal legs fixedly disposed above the rail flanges.

With these and other objects in view which will more readily appear as the nature of the invention is better understood, the invention consists in the novel construction, combination and arrangement of parts hereinafter more fully described, illustrated and claimed.

Similar reference characters designate corresponding parts throughout the several figures of the drawings.

Figure 1:
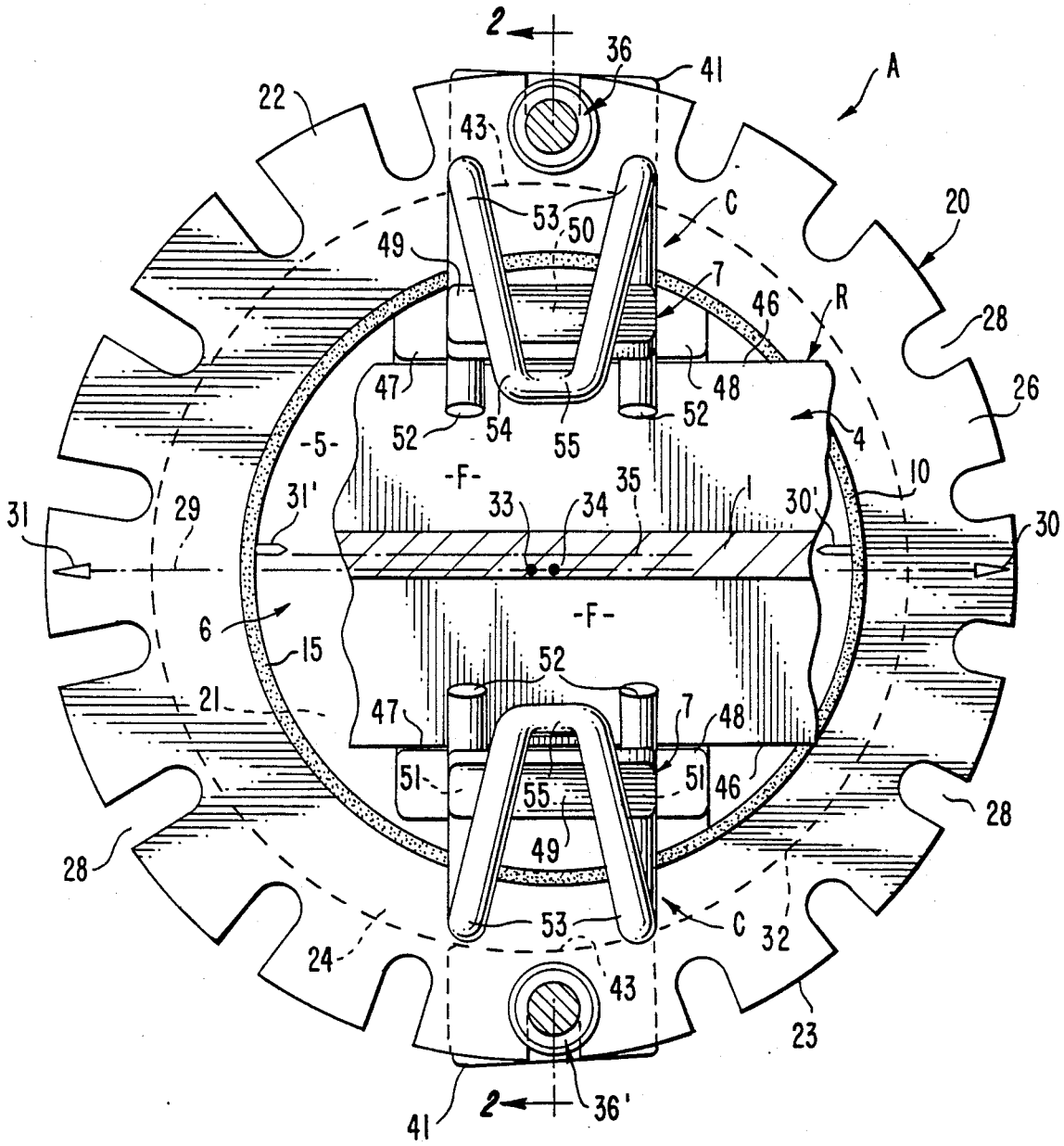
FIG. 1 is a top plan view, partly in section, of one form of an adjustable rail fastener assembly according to the present invention.
Figure 2:
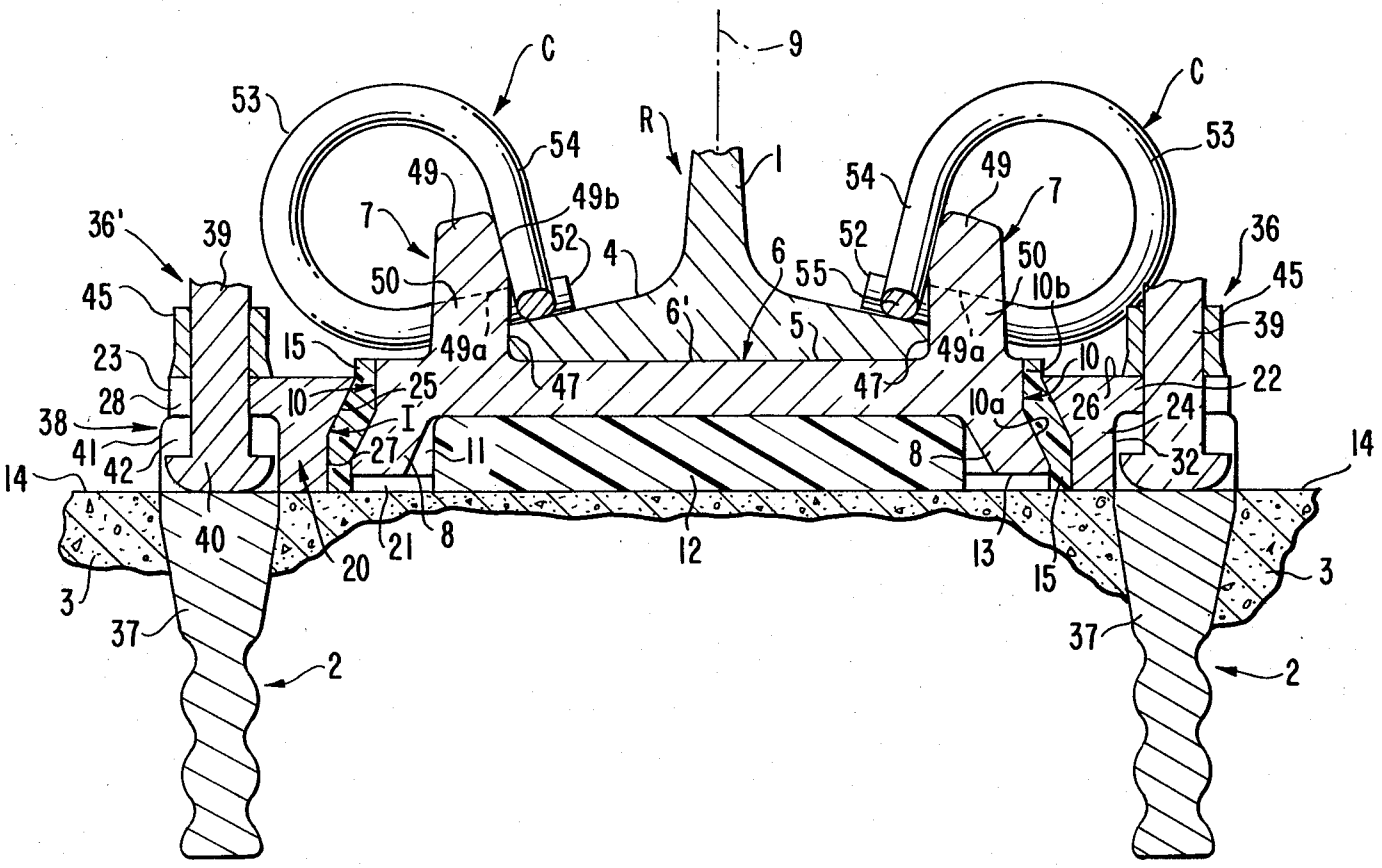
FIG. 2 is a vertical cross-sectional view taken along the line 2—2 of FIG. 1 illustrating one type of insert contained within a supporting foundation.

Referring now to the drawings, particularly FIGS. 1 and 2, the present invention will be understood to comprise an adjustable rail fastener assembly, generally designated A, and which readily lends itself to the selective lateral adjustment of a supported rail R. As viewed in the illustration of FIG. 2, such adjustment refers to the position of the vertical axis of the rail web 1 with respect to the two anchor means or inserts 2-2 as provided within the underlying foundation member 3, the latter of which may comprise either a wooden, synthetic or concrete cross-tie or a concrete slab.

During the operation of the present device, the inserts 2 or equivalent anchor means associated with the supporting cross-tie or slab will be understood to only be the truly fixed components associated with the present assembly since, during manipulation of the instant fastener assembly, the remaining components thereof are all laterally and/or arcuately displaced. Regarding these anchor means, it will be appreciated that the relative position therebetween as well as the number thereof may be altered, such as depicted in the various embodiments herein.

The flanges F-F of the rail base 4 will be seen to be supported upon the platform 5 of a seat member 6 between the confines of two shoulders 7-7 projecting upwardly from diametrically opposed areas of the circular seat base 6'. As shown most clearly in FIG. 2 of the drawings, the seat member 6 includes a depending annular flange 8 with the two shoulders 7 adjacent thereto. In the case of the left-hand shoulder 7 as depicted in FIG. 2, an eccentricity is evident between the center line 9 of the rail and circles passing through the outer wall 10 of the depending flange 8 and the two shoulders 7. The significance of this relationship will become apparent hereinafter.

The outer wall 10 of the seat member 6 will be seen to comprise a compound configuration i.e. the wall includes a lowermost downwardly and outwardly inclined surface 10*a* and an uppermost substantially vertical surface 10*b*.

The seat member 6 preferably comprises a circular member when viewed in plan but conceivably can be formed as an elongated component with two segmented depending flanges (not shown) at least providing a curved or arcuate surface on the outer walls thereof adjacent the two shoulders 7. In any case, it will be seen that a bottom cavity 11 is formed beneath the seat base 6' between the depending flange 8 and serves to receive the upper portion of an appropriate elastomeric bearing pad 12 adapted to support the rail installation with the bottom 13 of the seat flange 8 sufficiently spaced above the upper surface 14 of the foundation 3 at all times even when subjected to maximum loading.

Following installation of the components as described up to this point, an isolator 15 comprising a ringshaped member providing suitable electrical and structural characteristics, is placed about the outer periphery 10 of the seat member 6 as shown in FIG. 2 of the drawings. Thereafter, a clamp ring 20 having an enlarged seat-receiving opening 21 therethrough is lowered about the isolator ring 15. This clamp ring 20 will be seen to include an elevated, outwardly directed portion formed as a flange 22 terminating in an outer or peripheral edge 23. Extending downwardly from this flange 22 is a depending annular portion 24.

The relationship between the juxtaposed surfaces of the assembled seat member and clamp ring should be noted. In the case of the seat member 6, the outer peripheral wall comprises a downwardly and outwardly directed wall 10 while in the case of the surface of the clamp ring 20 which provides an interior opening 21, a downwardly and outwardly inclined inner wall I is formed. In the specific instance of the embodiment of FIG. 2, the inner wall I defining the clamp ring opening 21 comprises an uppermost section which will be seen to be a downwardly and outwardly inclined surface 25 extending from the top surface 26 of the clamp ring and communicates with a lower section or surface 27 which is substantially vertically disposed, and extends to the bottom of the clamp ring. Various other combinations of cooperating surfaces between the two juxtaposed members may, of course, be employed with the idea that the isolator element 15, working in concert with the cooperating surfaces of the rail seat and clamp ring, allows relative angular displacement between the components while the isolator element 15 and bearing pad 12 serve to control vertical displacement of the rail seat member 6 when the clamp ring 20 is anchored with respect to the underlying foundation surface 3. System specifications call for a particular vertical spring rate for the rail seat and although this vertical flexibility is limited, it will be understood to fall within the range allowed by the elastic deflection of the selected isolator-/insulator elements.

The clamp ring 20 is shown most clearly in FIG. 1 wherein it will be seen that the outer peripheral edge 23 is formed with a plurality of fastener-receiving means 28 each of which may comprise a hole formed through the ring flange 22 or an elongated slot or opening such as illustrated in FIG. 1 of the drawings. In a review of this drawing figure, it will be noted that the radial extent of the plurality of slots 28 from the outer edge 23 is equal for all the fastener receiving openings 28. Accordingly, in view of the offset disposition of the seat opening 21, the distance from each fastener opening 28 to the inner wall 25,27 of the clamp ring progressively increases/decreases as one moves from a first alignment bar or mark 30 on the top 26 of the clamp ring to an opposed mark 31. The seat receiving opening 21 extending through the clamp ring is depicted in FIG. 1 as being offset with respect to the outer edge 23 of the clamp ring as well as the outer wall 32 of the clamp ring depending portion 24. It is important to note that the illustrated construction of the clamp ring outer periphery 23 is merely exemplary as any external configuration may be utilized in combination with the underlying concept herein. The primary feature is that the wall of the ring seat receiving opening 21 is variably spaced from a plurality of fastener receiving openings 28 in the ring flange 22. Likewise, for a particular installation, it is possible that these openings 28 may not be angularly equidistant one another as depicted in FIG. 1.

The arrangement as shown in FIG. 1 depicts the rail fastener assembly as it appears in a neutral position, that is, the center 33 of the clamp ring 20 as well as the center 34 of the seat member 6 are both disposed along the clamp ring center line 29. From this position, the center line 35 of the rail can be shifted laterally in one direction or the other upon movement of the seat member 6 whereupon subsequent angular displacement of the clamp ring 20 will permit alignment of the slots or openings 28 with the stationary inserts or holddown means in the foundation 3. If the alignment mark 30, for example, is displaced counter-clockwise from the position as shown in FIG. 1, the base or center of the openings 28 on the clamp ring will progressively move closer to the relatively fixed rail and seat member in the area of the top-most fastener 36. On the other hand, if the clamp ring mark 31 is moved clockwise from the position as shown in FIG. 1, toward the location adapted to receive the fastener 36, then the center points of the openings 28 will be progressively moved further away from the fastener 36. Thus, any shifting of the rail R and seat 6 in either lateral direction from that shown in FIG. 1 may be accommodated with the same two anchoring fasteners by the foregoing manipulation of the clamp ring 20.

As previously mentioned, the two upstanding shoulders 7-7 are asymmetrical with respect to the outer wall 10 and center point 34 of the seat member 6. This relationship will be readily apparent from a review of both FIGS. 1 and 2. In FIG. 1, for example, the top-most shoulder is noticeably closer to the seat periphery 10 than the bottom-most shoulder. As assembled in this view, two oppositely disposed bars or marks 30',31' on the top of the seat member 6 are clearly laterally offset from a line joining the two clamp ring indicia 30,31. With the foregoing arrangement, it will be understood that by rotating the seat member 180° from the position of FIG. 1, the shoulder relationship is altered such that still further lateral rail adjustment becomes available. This is possible due to the resultant offset of the rail platform 5 due to the lateral shifting of the two shoulder lower rail sections and will be reflected by a re-location of the seat member indicia 30',31' to the opposite side of the line joining the clamp ring indicia 30,31.

The construction of the specific fasteners 36-36' employed to secure the clamp ring 20 to the upper surface 14 of the foundation 3 may vary depending upon the type of foundation involved. In the case of the installation illustrated in FIGS. 1 and 2 of the drawings, the foundation may be considered to comprise concrete cross-ties or a concrete slab 3. An appropriate anchoring arrangement for such installation may comprise integral inserts 2 having a lower stem 37 embedded within the concrete of the foundation and a head 38 extending above the foundation upper surface 14. These inserts 2 may be cast within the foundation member at the time of its manufacture or alternatively, inserted within holes drilled therein and subsequently grouted in place. With such an arrangement, at least a pair of these inserts will be understood to be provided for each rail fastener assembly and located for example, at diametrically opposed positions for cooperation with a pair of the clamp ring fastener-receiving openings 28-28. The very procedures used to embed the inserts within the foundation all the more point to the advantages of the instant adjustable assembly. No satisfactory method is known for efficiently and accurately positioning the inserts within a concrete foundation such that proper track spacing will be achieved without some manipulation, which usually involves inserting one or more shims in order to align the track while using existing fastener assemblies. The problem will be appreciated when it is understood that tolerances on alignment and surface of a good transit track is in the 1/16" or ⅛" category while the tolerance in floating of concrete surfaces may be in the ¼" or ½"category. Also, prestressed members have a tendency of cambering upward at the center and on a 100 ft. aerial member this could amount to several inches. The result of this mismatch of tolerances and the lack of accurate means to install the hold downs or inserts to tolerance, has precipitated the development of the current assembly.

Anchoring of an adjusted assembly to the foundation member 3 may be accomplished by utilizing any suitable fasteners such as the elements 36-36' each having a central shank 39 provided with a lowermost enlarged head 40 as shown most clearly in FIG. 2. To provide an enlarged area subjected to the clamping force of an installed fastener 36-36', each insert 2 is formed with a top-most fastener plate 41 comprising a planar member having a central opening 42 through which the fastener shank 39 is passed prior to positioning the fastener components as shown in FIGS. 1 and 2. This plate 41 is provided with an arcuate inner wall 43 the radius of which corresponds to that of the circular outer wall 32 of the clamp ring depending portion 24 so that when an appropriate lock/grip element 45 is applied to the upper portion of the fastener shank 39, the plate will flushly engage a substantial portion of the clamp ring. The fastener shank 39 and lock/grip element 45 may comprise, for example, a huckbolt assembly. The preceding described fastener construction will be understood to be optional since other well known devices quite obviously may be employed such as the hold-down means depicted in connection with embodiments described hereinafter.

The description up to this point covers the construction of anchoring of the seat member 6 and clamp ring 20 with respect to the foundation 3. To complete the rail fastener assembly, replaceable means must be provided to retain the rail R in its proper position upon the rail platform 5 of the seat member. This is accomplished by means of a pair of spring clips C-C for each assembly A. Each clip C comprises a unitary symmetrical element formed of metal, wire, rod or bar stock, preferably configured as shown in the drawings to provide alternate portions respectfully engaging the seat member shoulders 7 and each flange F of the rail base 4. For any one position of angular adjustment of the clamp ring 20, the rail R is retained in the selected lateral position by the engagement of the two rail flange edges 46-46 between the opposed inner walls 47-47 of the two lower rail sections 48 of the shoulders 7. These lower rail sections will be seen to comprise integral portions of the seat member 6 projecting upwardly from the plane of the platform 5 to a point substantially equal to the height of each rail flange edge 46. Each shoulder 7 also includes an upper rail clip section 49 projecting upwardly from the lower rail section 48 and which may be of shorter longitudinal extent than the lower rail section 48 as shown in FIG. 1 of the drawings. The upper rail clip section 49 is spaced above the lower rail section 48 and joined thereto by means of a central web 50 thereby providing two opposite undercut areas 51-51 for each shoulder 7 in effect forming a T-shaped structure upstanding from each lower rail section 48.

One clip C cooperates with the above described shoulder construction to bias each flange F of the rail base 4 downwardly toward the rail platform 5 of the seat member 6. Each clip includes a pair of shoulder engaging legs or fingers 52-52 laterally spaced apart from one another and adapted to be inserted within the two undercut areas 51-51 of each shoulder 7. The two shoulder engaging legs 52-52 are each joined to an arcuate portion 53 which from FIG. 2 of the drawings, will be seen to define an arc of substantially greater than 180°. These two arcuate portions 53-53 are in turn joined to a pair of rail engaging legs 54-54 respectively attached to opposite ends of a rail hold-down portion or toe 55, the latter of which is substantially horizontally disposed and located between the spaced apart distal portions 52'-52' of the two shoulder engaging legs 52-52.

The two clips C-C for each rail fastener assembly A are applied, by an appropriate tool, into the installed position as shown in the drawings such that when fully installed, the two shoulder engaging legs 52-52 are biased upwardly beneath the upper rail clip section 49 of the shoulder 7 while the rail hold-down portion 55 of the clips apply a constant downwardly directed force upon the respective flange of the rail base 4. The symmetrical configuration of both the individual shoulders 7 and clips C will be understood to allow installation of any single clip upon either shoulder of a rail seat and this installation may be accomplished from either side of each shoulder.

The cross-sectional view of FIG. 2 most clearly shows the relationship of the clips C-C and the shoulders 7 and this relationship is generally similar throughout all embodiments even though slight variations exist in clip or shoulder configuration. To provide quidance and control of the clip during its installation the shoulder upper sections 49 are formed with a downwardly facing ramp **49*a* defining the upper limit of each undercut area 51. Additionally, a slope 49*b* is formed on the portion of each shoulder facing a respective rail flange. The ramps 49*a* are essential to provide guidance for the clip shoulder engaging legs during installation while the slope 49*b* will be seen to cooperate with the clip rail engaging legs. This latter arrangement prevents the clip from working out of its installed position and additionally, provides a degree of control as to where the clip hold-down portion 55** contacts the rail so as to better maintain control on toe load.

With the foregoing structure in mind, it will be understood that a vastly improved rail clip arrangement is offered wherein a relatively low spring rate is utilized without the potential of overstressing and yielding of the clip. This is accomplished by the fixed disposition of the shoulder-engaging legs 52-52 such that their distal portions 52'-52' remain mounted in a stationary, overhanging manner atop each rail base flange F. With each clip thus mounted, the intermediate rail hold-down portion or nose 55 constantly engages a respective rail flange F with a downwardly disrected biasing force to urge maintenance of the seated disposition as shown in FIG. 2 of the drawings. At this point, only a small space exists between each clip leg 52 and the underlying rail flange. However, during passage of traffic over the rail, forces tending to vertically displace either rail flange F are initially resisted by the respective clip nose 55 biased thereagainst and subsequently arrested as the rail flange abuts the stationary clip legs 52-52.

Figure 3:
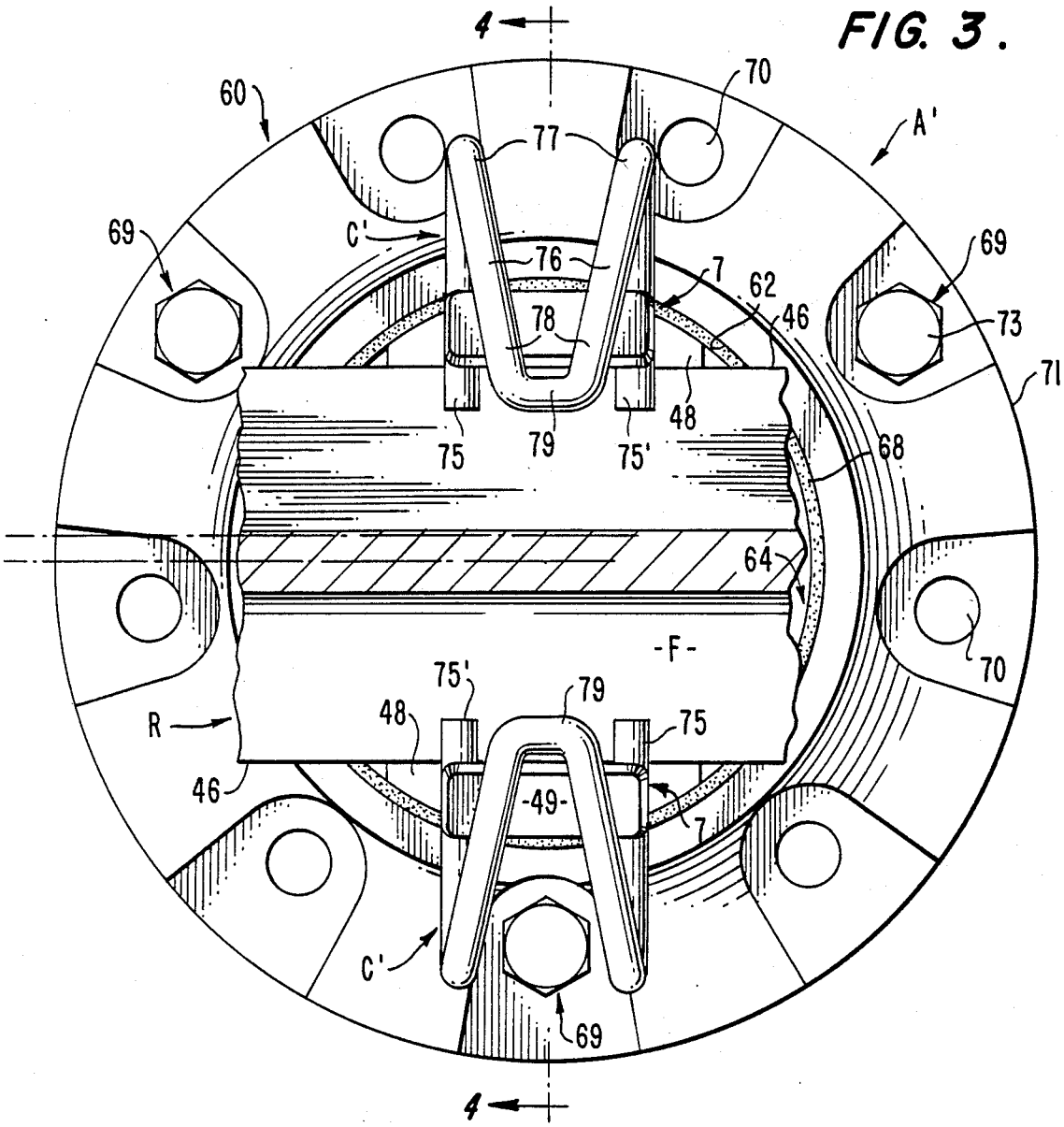
FIG. 3 is a top plan view, partly in section of another embodiment of the present invention.
Figure 4:
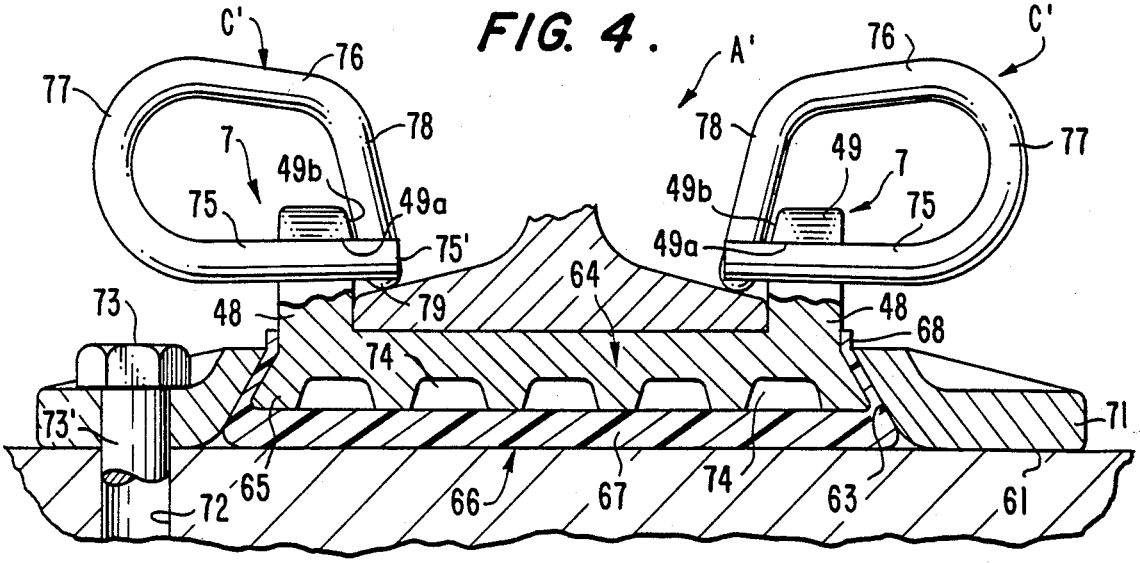
FIG. 4 is a vertical sectional view taken along the line 4—4 of FIG. 3 illustrating another type of ring fastener.

The embodiment illustrated in FIGS. 3–4 of the drawings discloses a rail fastener assembly A' generally similar to that of the assembly A with the primary distinction being the provision of a modified clamp ring and associated fasteners for the foundation. In this embodiment, the clamp ring 60 includes a bottom wall 61 adapted to be flushly disposed atop the upper surface 14 of a foundation member with a central concentric seat-receiving opening 62 formed therein by means of an inwardly inclined inner wall 63 on the clamp ring. The seat member 64 comprises a circular element provided with a depending annular flange 65 which is inclined downwardly and outwardly from the top to the bottom thereof. As in the case of the previously described seat member 6, the outer diameter of the bottom of the annular flange 65 is no less than the internal diameter of the top of the seat opening formed by the inner wall 63 of the clamp ring 60.

In this latter embodiment, the bearing pad 12 and isolator ring 15 of the first described embodiment are combined as a single insulator/bearing pad 66 comprising a pad base 67 adapted to fully underlie the seat member 64 and which includes an integral, upwardly directed pad flange 68 intended to be sandwiched between the clamp ring inner wall 63 and seat member annular flange 65 as the assembly is clamped to the foundation member 3. Again, any appropriate fastener means may be utilized to secure at least two angularly spaced peripheral points of the clamp ring 60 to the underlying foundation member. FIGS. 3 and 4 of the drawings disclose three fasteners 69 located through three fastener-receiving openings spaced inwardly from the ring outer edge 71 and extending through the clamp ring bottom wall 61. In this instance, the three fasteners are angularly spaced apart from one another 120°. From a review of FIG. 3, it will be seen that the centers of the plurality of fastener-receiving openings 70 are variably spaced from the inner wall 63 defining the seat-receiving opening of the clamp ring such that following proper lateral positioning of the rail R and its seat member 64, the clamp ring is arcuately displaced to vertically align selected ones of the openings 70 with respect to preformed holes 72 in the foundation. Any suitable bolt anchor means (not shown) may be provided within the foundation member 3, such as well known anchor or hold-down elements, adapted to cooperate with the shanks 73' of the fasteners 69 to securely retain the fasteners so that the heads 73 thereof may be tightened by means of an appropriate tool.

The seat member 64 will be seen from FIG. 4 to be provided with a plurality of openings 74 in its undersurface which distinguishes its construction from that of the seat member 6 provided with the single bottom cavity 11. The opening 74 may be arranged in any suitable configuration and may comprise separate spaced apart holes or concentric rings, etc. In any case, it is preferable that these openings 74 provide a symmetrical arrangement on the bottom of the seat member 64 to equally distribute any load transmitted thereby upon the insulator pad base 67. As in all described embodiments herein, it will be understood that the exact configuration or thickness of the insulator pad or pad base may be varied for any specific assembly so that the overall elastic deflection characteristics are achieved. The restraints applied to the elastomeric elements by the geometry of the relatively rigid seat and ring determine how these elements are allowed to flex and thereby determine the lateral and vertical deflection characteristics.

In the process of assembly of any form of the present invention, the prescribed height for an installed rail is achieved by utilizing appropriate shims of high density material such as polyethylene, atop the foundation member 3 and beneath the seat member, after which the outside or clamp ring is lowered, rotated as necessary, and bolted down.

The clips C' associated with the rail fastener assembly A' are generally similar to the earlier described clips C in that a pair of shoulder engaging legs 75-75 are disposed beneath the upper rail clip section 49 of the shoulder 7 with their distal portions juxtaposed but not engaging, the respective rail flanges F. The clip C' may differ from the clip C in the inclusion of the intermediate straight portions 76-76 between the arcuate portions 77-77 and the rail engaging legs 78-78 the latter of which are joined to the rail holddown portion 79.

At this point, it would be well to appreciate that variations in the spacing or location of the hold down or clamp ring fasteners may be employed. In the case of the assembly A of FIGS. 1–2, a pair of diametrically opposed fasteners are shown while the assembly A' of FIGS. 3–4 will be seen to utilize three fasteners at 120° spacing.

The fastener assemblies illustrated in FIGS. 5–9 of the drawings include seat members having alternate configurations on the undersurface thereof cooperating with modified insulator pads and/or isolator rings. These insulating members are shown in combination with a clamp ring 85 which will be seen to comprise a combination of the features of the previously described clamp rings 20 and 60. As shown most clearly in FIGS. 5 and 6, the clamp ring 85 includes a circular or otherwise configured outer edge 86 extending vertically from a top surface 87 to a bottom wall 88. As in the clamp ring 60 of FIGS. 3–4, this bottom wall 88 is adapted to be disposed atop the upper surface 14 of a foundation member 3 and is rigidly affixed thereabove by means of appropriate fasteners 69, the shanks 73' of which are retained within the foundation member by appropriate anchor means (not shown).

Similar to the previously described embodiments, a plurality of fastener-receiving openings 89 are formed through the clamp ring 85 adjacent its outer edge 86 with all of these angularly spaced apart openings 89 being disposed upon a circle 90 which is eccentric with respect to a seat-receiving opening 91. With the above construction in mind, it will be appreciated that with the seat-receiving opening 91 formed within the clamp ring 85 eccentric with respect to the circle 90 through which the fastener-receiving openings 89 pass, subsequent rotation of the clamp ring will position alternate pairs of oppositely disposed ones of the openings 89 opposite the two edges 46-46 of the rail base 4. This will produce a lateral displacement of the openings 89 with respect to the rail center line 9 until two openings 89 are positioned in overlying registry with the two preformed holes/anchor means in the foundation 3. As will be noted from FIG. 5, the plurality of ring openings 89 are not all equi-distant from each other. Thus, in any clamp ring a specific angular spacing between the openings may be used which is necessary to provide the required range and increments of lateral adjustment.

Figure 5:
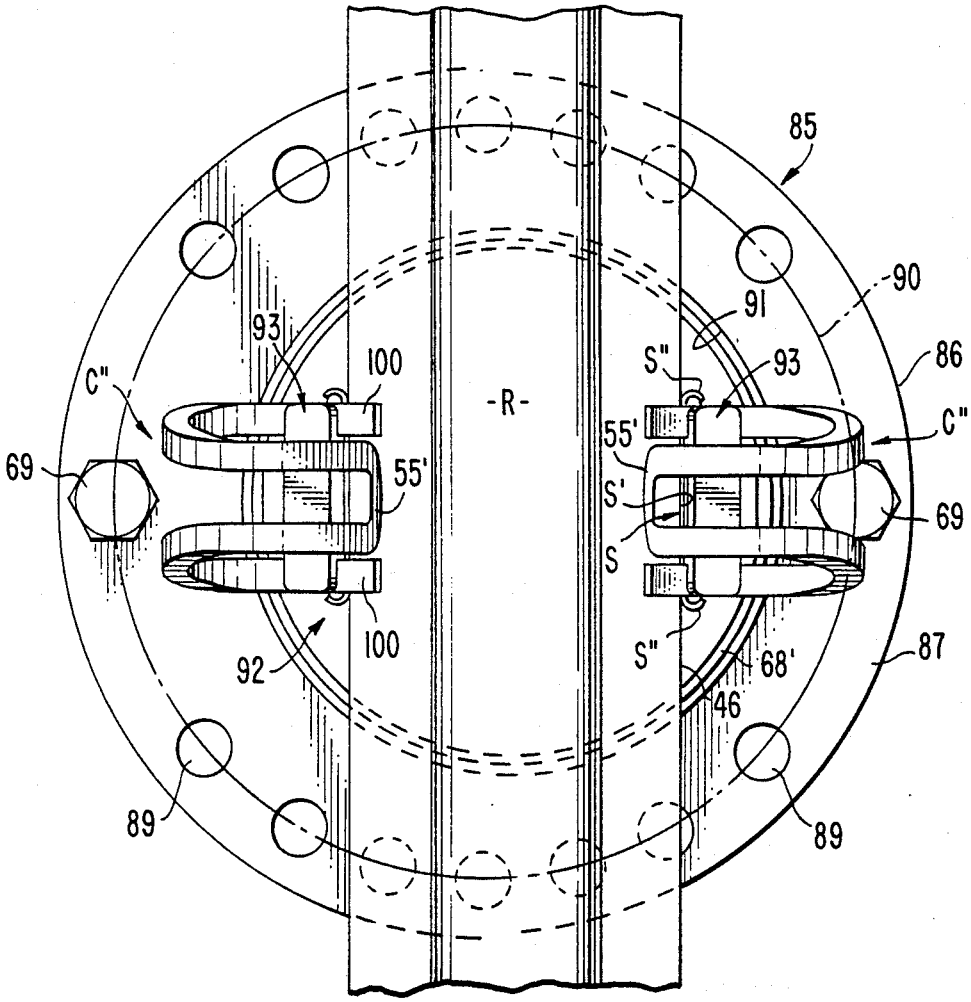
FIG. 5 is a top plan view of a further embodiment.
Figure 6:
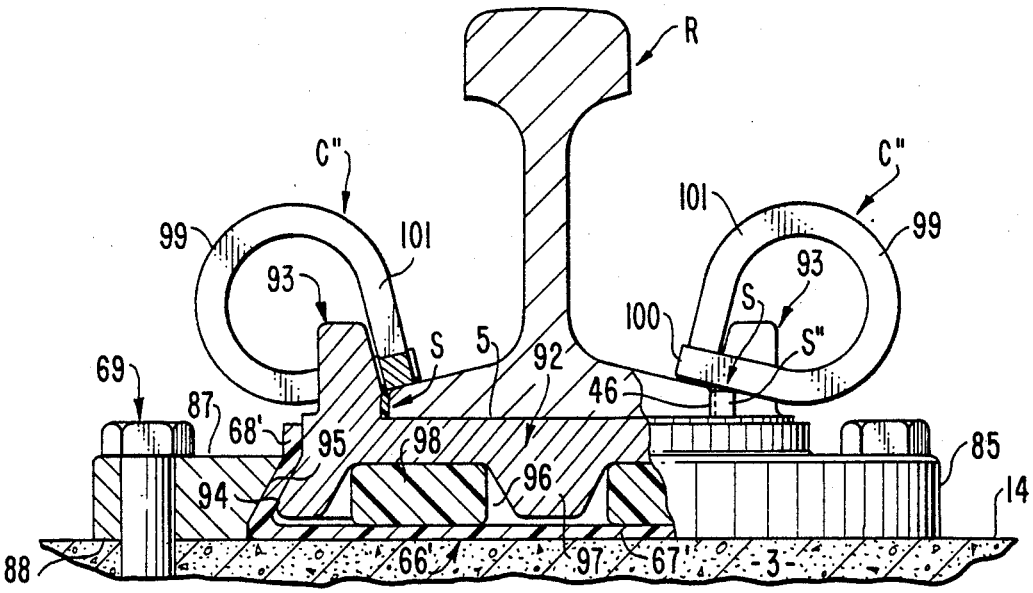
FIG. 6 is a transverse view, partly in section, of the assembly of FIG. 5.

The seat member 92 shown in FIGS. 5 and 6 of the drawings includes a rail platform 5 similar to the previously described seat members for containing a rail base between the two opposed shoulders 93-93 and a depending annular flange 93 formed with an outwardly and downwardly directed annular peripheral wall 94 adapted to be juxtaposed the inclined eccentric inner wall 95 of the clamp ring 85. The undersurface of the seat member 92 is formed with an enlarged circular opening 96 as provided between the depending flange 93 and a central downwardly directed protrusion 97.

Isolating and supporting the installed clamp ring and seat member is an insulator pad 66' generally similar to the pad 66 shown in the embodiment of FIGS. 3–4 and which includes a pad base 67' and an annular flange 68' adapted to isolate the opposed peripheral walls of the clamp ring and seat member as shown most clearly in FIG. 6 of the drawings. Additionally supporting the seat member when installed, is a doughnut or ring support or bearing pad 98 positioned within the seat member circular opening 96 and having a vertical height normally maintaining the bottom of the seat member 92 spaced above the insulator pad base 67'. As described earlier, appropriate shims may be placed beneath the seat assembly prior to application of the clamp ring.

A further modification is shown in the embodiment of FIGS. 5–6 which may be employed in combination with any of the various forms of this invention to preclude wear at the juncture of each rail flange edge 46 and shoulder 93. A replaceable wear plate or shim S will be seen to be inserted intermediate these two normally abutting areas and comprises a strip-like metal member having a central body portion S' substantially the length of the shoulder and bounded by opposite bent or curled end tabs S'' which may frictionally engage the lower portion of each shoulder. The metal from which the plate is constructed should not be so hard that it will wear into the rail flange nor should it be so soft that it will break apart. An appropriate material would be low carbon steel having a hardness above that of the shoulder iron casting and just below that of the rail base flange. In this manner, the shim or plate S will wear rather than the rail. Accordingly, the plate hardness can range between $75R_B$ and $28R_C$.

The spring clip C'' as depicted in the embodiment of FIGS. 5–9 will be seen to be configured, when viewed in side elevation, similar to the clip C associated with the embodiment of FIGS. 1–2. However, two distinctions will be noted. The clip C'' is constructed from square or rectangular bar stock and the arcuate portions 99-99 joining the shoulder engaging legs 100-100 to the rail engaging legs 101-101 will be seen to be slightly twisted such that portions of the arcuate portions 99 adjacent the rail engaging legs 101 are disposed in planes substantially parallel to the shoulder engaging legs 100 as viewed most clearly in FIG. 5 of the drawings.

Figure 7:
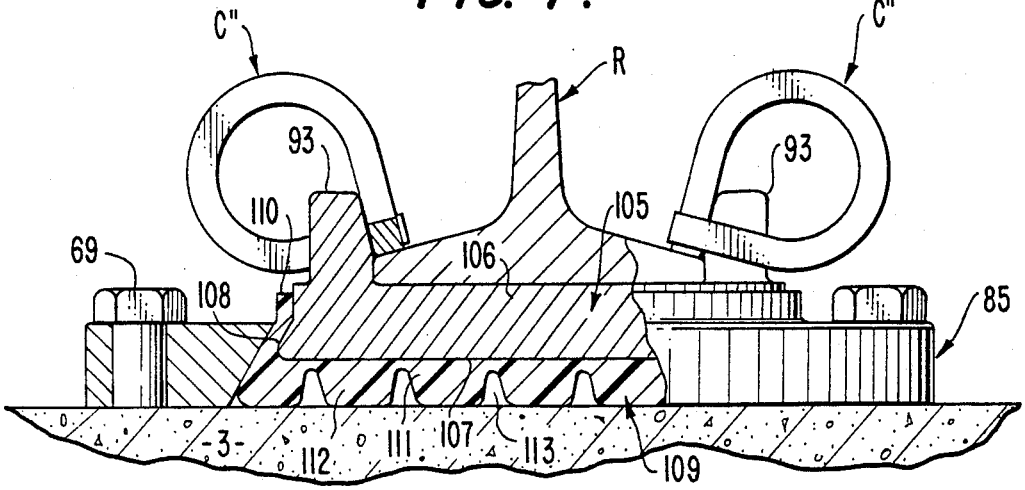
FIGS. 7–9 are transverse views similar to FIG. 6 of additional modifications.
Figure 8:
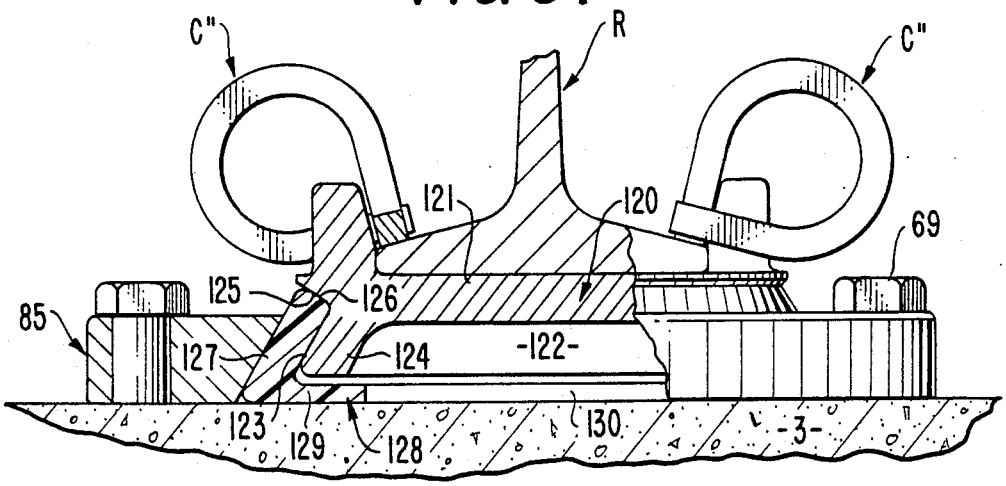
Figure 9:
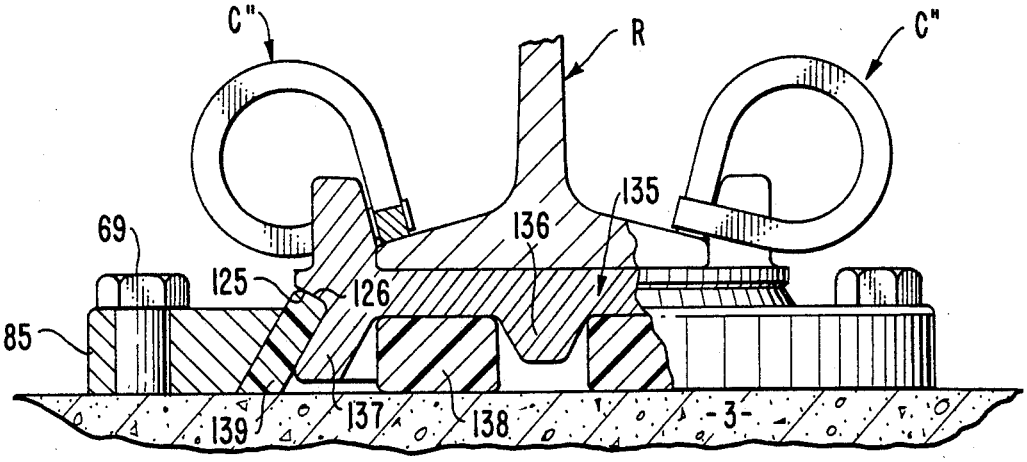

The variations contained in the fastener assemblies shown in FIGS. 7–9 comprise alternate construction for the seat member base and the associated insulator member or members.

In FIG. 7, the seat member 105 includes a base 106 having a substantially planar bottom face 107 and which is surrounded by an outer wall comprising a downwardly and outwardly inclined surface 108. This seat member 105 when anchored in place by means of the clamp ring 85 is insulated with respect to the foundation member 3 and clamp ring 85 by means of a unitary elastomeric insulator pad 109 comprising an annular, peripheral ring portion 110 joined to a pad base 111 having a plurality of downwardly directed protrusions 112 formed by a plurality of concentric or otherwise spaced openings 113. This embodiment may involve bonding of the pad 109 to the seat 105 to preclude migration of the pad during use.

In the embodiment of FIG. 8, the seat member 120 is formed with a base 121 having a single enlarged bottom cavity 122 similar to the seat member 6 in the first described embodiment. The outer peripheral wall 123 of the depending flange 124 of the seat will be seen to communicate with an outwardly offset shoulder wall 125 which is intended to overhang and abut the top surface 126 of the peripheral flange 127 of an insulator pad 128. In this manner, the elastomeric composition of the pad flange is placed in both compression and shear, becomes a load bearing member and is prevented from extruding out of the fastener assembly. This peripheral flange 127 is joined to a pad base 129 adapted to abut the upper surface 14 of the foundation member 3 and will be seen to be provided with an enlarged central opening 130. Quite obviously, the opening 130 may be omitted but since the juxtaposed area of the seat member 120 is formed with the enlarged bottom cavity 122, a savings in material can be realized by providing the pad opening 130 in an area which will be always removed from contact with metallic components of the rail fastener assembly.

The remaining assembly shown in FIG. 9 of the drawings includes a seat member 135 which is similar to the seat member 120 of FIG. 8 with the inclusion of a central, downwardly directed protrusion 136 which will be seen to be analogous to that of the seat member 92 as shown in FIG. 6. A distinction is that the protrusion 136 terminates at a point substantially disposed above the plane of the bottom of the seat member peripheral flange 137 for reasons which will become obvious immediately hereinafter. This latter embodiment employs multi-part insulator components comprising a doughnut or ring support pad 138 surrounding the protrusion 136 and a separate isolator ring 139 intermediate the seat member 135 and clamp ring 85. Since there is no pad base beneath the entire surface of the seat member, it follows that the thickness or height of the ring support pad 138 is noticeably greater than that of the support pad 98 in FIG. 6 to insure that regardless of the load imposed upon the assembly of FIG. 9, no portion of the seat member will abut either the clamp ring 85 or the underlying foundation member 3.

The embodiments of FIGS. 8 and 9 provide a unique boundary control of the insulator elements sandwiched between the seat and ring components resulting in a significant economic advantage over existing transit fasteners which utilize bonded or vulcanized components. The nonbonded construction of the referenced embodiments prevents the insulator material from extruding out of the fastener assemblies without the added cost of resorting to any bonded construction.

The various configurations exhibited by the numerous embodiments disclosed herewin will be understood to allow selection of alternative degrees of vibration and sound isolation as well as control of the loading factor upon the various components.

I claim:

1. A rail fastener assembly for attaching a rail base to a foundation comprising, a seat member disposed atop the foundation and having an upwardly directed rail platform adapted to receive the rail base, said seat member including an outer peripheral wall, a clamp ring having an outer edge and provided with a seat-receiving opening including an inner wall, said inner wall surrounding said seat member outer peripheral wall, a plurality of angularly spaced apart fastener-receiving openings through said clamp ring adjacent said ring outer edge, fasteners disposed through at least a pair of spaced apart ones of said fastener-receiving openings, said fasteners including means on the one hand anchoring said fasteners relative to said foundation and on the other hand urging said clamp ring toward said foundation to clamp said seat member in a substantially fixed position, said clamp ring seat-receiving opening being eccentric relative said plurality of fastener-receiving openings whereby said clamp ring is angularly displaceable to vertically align selected ones of said fastener-receiving openings with said foundation anchoring means, and a pair of spring clips each having alternate portions respectively engaging said seat member and resiliently bearing down upon said rail base.

2. A rail fastener assembly according to claim 1 wherein, said clamp ring fastener-receiving openings are disposed along a circle eccentric with said clamp ring inner wall.

3. A rail fastener assembly according to claim 1 wherein, said clamp ring fastener-receiving openings are angularly equi-distant one another.

4. A rail fastener assembly according to claim 1 wherein, pairs of said clamp ring fastener-receiving openings are diametrically opposed.

5. A rail fastener assembly according to claim 1 wherein, said clamp ring inner wall is circular and is joined to an outwardly directed portion, said inner wall provided with an upwardly and inwardly inclined surface, said seat member outer peripheral wall provided with a downwardly and outwardly inclined surface and insulating means between said clamp ring inner wall and seat member outer peripheral wall whereby, upon tightening of said fasteners said clamp ring inner wall bears downwardly upon said insulating means and seat member outer wall to fixedly urge said seat member toward said foundation.

6. A rail fastener assembly according to claim 5 wherein, said clamp ring inner wall includes a substantially vertical surface below said upwardly and inwardly inclined surface and said seat member outer wall includes a substantially vertical surface above said downwardly and outwardly inclined surface.

7. A rail fastener assembly according to claim 5 including, a shoulder wall projecting outwardly from said seat member outer wall and said insulating means between said clamp ring and seat member walls provided with a top surface abutting said shoulder wall.

8. A rail fastener assembly according to claim 1 wherein, said seat member outer peripheral wall and clamp ring seat-receiving opening are circular, a pair of shoulders extending upwardly from said seat member adjacent diametrically opposed areas of said rail platform, said rail base including opposite flanges disposed between said shoulders, and one said spring clip retained by each said shoulder and bearing upon each said rail flange.

9. A rail fastener assembly according to claim 8 including, a replaceable wearplate intermediate each said shoulder and rail base flange.

10. A rail fastener assembly according to claim 8 wherein, each said spring clip comprises a symmetrical element.

11. A rail fastener assembly according to claim 8 wherein, each said spring clip is formed from substantially circular stock.

12. A rail fastener assembly according to claim 8 wherein, each said spring clip is formed from substantially rectangular stock.

13. A rail fastener assembly according to claim 8 wherein, said shoulders are asymmetrical with respect to the center of said seat member whereby, angular displacement of said seat member 180° laterally shifts the position of a rail base supported thereupon.

14. A rail fastener assembly according to claim 8 wherein, each said shoulder includes a central web joined to an upper most rail clip section and providing opposite undercut areas therebeneath, said spring clip alternate portions including a pair of shoulder-engaging legs extending through said undercut areas, said clip alternate portions further including an intermediate hold-down portion on each said spring clip biased against one said rail base flange, and the distal portion of said shoulder-engaging legs of each said clip disposed in a fixed overlying manner spaced above each said rail base flange to limit deflection of said clips upon vertical movement of said rail base flange.

15. A rail fastener assembly according to claim 14 wherein, each said spring clip includes a pair of rail engaging legs joined to said hold-down portion, each said shoulder rail clip section provided with a pair of downwardly facing ramps defining the upper limits of said undercut areas whereby, as said clips are applied, said shoulder-engaging legs engage and are guided by said ramps with said ramps providing said fixed disposition of said shoulder-engaging legs.

16. A rail fastener assembly according to claim 15 wherein, each said shoulder includes a slope formed adjacent a respective one said rail base flange whereby, as said clips are applied, said rail engaging legs engage said slope.

17. A rail fastener assembly according to claim 1 wherein, said seat member includes a base beneath said rail platform, and isolator means between said seat member base and foundation as well as intermediate said clamp ring inner wall and seat member outer peripheral wall whereby, said isolator means between said member base and foundation serves as a bearing member supporting said rail base upon said foundation.

18. A rail fastener assembly according to claim 17 wherein, said seat member includes a bottom having a least one opening therein and said isolator means between said seat member base and foundation is at least partially disposed within said seat member bottom opening.

19. A rail fastener assembly according to claim 17 wherein, said isolator means includes a unitary bearing pad joined to an annular upstanding flange.

20. A rail fastener assembly according to claim 17 wherein, said isolator means includes a separate bearing pad and ring element.

21. A rail fastener assembly according to claim 1 wherein, said seat member includes a pair of upstanding shoulders bounding said rail platform, said spring clips each comprising a unitary member with said alternate portions including a pair of legs engaging one said shoulder and a rail hold-down portion biased against said rail base, a pair of rail engaging legs joined to opposite ends of said hold-down portion and an arcuate portion connecting each said rail engaging leg to one said shoulder engaging leg.

22. A rail fastener assembly according to claim 1 wherein, said fastener foundation anchoring means includes inserts within said foundation disposed on opposite sides of said seat member.

23. A rail fastener assembly according to claim 22 including, at least a pair of said fasteners diametrically disposed through said clamp ring fastener-receiving openings.

24. A rail fastener assembly according to claim 22 including, three said fasteners disposed through said clamp ring fastener-receiving openings and angularly spaced from one another 120°.

25. A rail fastener assembly according to claim 1 wherein, said clamp ring fastener-receiving openings are angularly variably spaced from one another.

* * * * *